United States Patent [19]

Ridley

[11] 4,239,283

[45] Dec. 16, 1980

[54] IN SITU OIL SHALE RETORT WITH INTERMEDIATE GAS CONTROL

[75] Inventor: Richard D. Ridley, Bakersfield, Calif.

[73] Assignee: Occidental Oil Shale, Inc., Grand Junction, Colo.

[21] Appl. No.: 17,348

[22] Filed: Mar. 5, 1979

[51] Int. Cl.[3] ..... E21B 43/247; E21C 41/10

[52] U.S. Cl. ..... 299/2; 166/258; 166/259

[58] Field of Search ..... 166/256, 258, 259, 247; 299/2, 13

[56] References Cited

U.S. PATENT DOCUMENTS

| | | | |
|---|---|---|---|
| 2,481,051 | 9/1949 | Uren | 299/2 |
| 2,630,306 | 3/1953 | Evans | 299/2 |
| 2,801,089 | 7/1957 | Scott, Jr. | 299/2 |
| 3,228,468 | 1/1966 | Nichols | 166/259 |
| 3,434,757 | 3/1969 | Prats | 299/2 |
| 3,454,958 | 7/1969 | Parker | 166/256 |
| 3,578,080 | 5/1971 | Closmann | 166/259 X |
| 3,950,029 | 4/1976 | Timmins | 166/256 X |
| 4,025,115 | 5/1977 | French et al. | 299/2 |
| 4,072,350 | 2/1978 | Bartel et al. | 299/2 |
| 4,102,397 | 7/1978 | Terry | 166/259 |
| 4,119,345 | 10/1978 | Bartel et al. | 299/2 |
| 4,147,388 | 4/1979 | French | 299/2 |
| 4,149,595 | 4/1979 | Cha | 166/259 |

*Primary Examiner*—Stephen J. Novosad
*Assistant Examiner*—George A. Suchfield
*Attorney, Agent, or Firm*—Christie, Parker & Hale

[57] ABSTRACT

A method for recovering liquid and gaseous products from an in situ oil shale retort in a subterranean formation containing oil shale is disclosed. The method is practiced on an in situ oil shale retort having a plurality of fragmented permeable masses of formation particles with an upper and at least one lower fragmented mass. A zone of unfragmented formation intervenes between such fragmented masses and has a plurality of vertically extending holes for distributing fluid from the fragmented mass above to the fragmented mass below the zone of unfragmented formation. A processing gas is introduced to the upper fragmented mass and an off gas is withdrawn from the lower fragmented mass establishing a retorting zone in the upper fragmented mass and advancing the retorting zone downwardly through the upper fragmented mass, through such holes in the zone of unfragmented formation, and into and through the lower fragmented mass. The oil shale within the fragmented masses is retorted producing liquid and gaseous products. The liquid products are recovered from the fragmented mass from which they are produced and the gaseous products are recovered from the off gas withdrawn from the lower fragmented mass.

44 Claims, 6 Drawing Figures

IN SITU OIL SHALE RETORT WITH INTERMEDIATE GAS CONTROL

BACKGROUND OF THE INVENTION

This invention relates to in situ recovery of shale oil, and more particularly, to techniques for minimizing any effect on gas flow resistance in an in situ retort caused by strata having a relatively lower kerogen content than the average kerogen content of formation within the retort site.

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen," which upon heating, decomposes to produce liquid and gaseous products. It is the formation containing kerogen that is called "oil shale" herein, and the liquid product is called "shale oil."

A number of methods have been proposed for processing the oil shale which involve either first mining the kerogen bearing shale and processing the shale on the surface, or processing the shale in situ. The latter approach is preferable from the standpoint of environmental impact since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598 which are incorporated herein by this reference. Such patents describe in situ recovery of liquid and gaseous materials from a subterranean formation containing oil shale by fragmenting such formation to form a stationary, fragmented permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing retorted oil shale.

According to a method disclosed in U.S. Pat. No. 4,043,595, for example, an in situ retort is formed by excavating formation from a columnar void bounded by unfragmented formation having a vertically extending free face, drilling blasting holes adjacent the columnar void and parallel to the free face, loading the blasting holes with explosive, and detonating the explosive. This expands the formation adjacent the columnar void toward the free face such that fragmented formation particles occupy the columnar void and the space in the in situ retort site originally occupied by the expanded shale prior to such explosive expansion. Similarly, U.S. Pat. No. 4,043,597 discloses a method of forming an in situ retort by forming horizontal voids within a retort site and blasting the formation adjacent such horizontal voids for forming a fragmented permeable mass of formation particles within the retort site.

Oil shale deposits occur in generally horizontal beds and within a given bed there are an extremely large number of generally horizontal deposition layers containing kerogen known as "varves." The kerogen content of the formation is typically nonuniformly dispersed throughout a given bed.

The average kerogen content of formation containing oil shale can be determined by a standard "Fischer assay" in which a core sample customarily weighing 100 grams and representing one foot of core is subjected to controlled laboratory analysis involving grinding the sample into small particles which are placed in a sealed vessel and subjected to heat at a known rate of temperature rise to measure the kerogen content of the core sample. Kerogen content is usually stated in units of "gallons per ton," referring to the number of gallons of shale oil recoverable from a ton of oil shale heated in the same manner as in the Fischer analysis.

The average kerogen content of formation containing oil shale varies over a broad range from essentially barren shale having no kerogen content up to a kerogen content of about 70 gallons per ton. Localized regions can have even higher kerogen contents, but these are not common. It is often considered uneconomical to retort formation containing oil shale having an average kerogen content of less than about 8 to 10 gallons per ton.

Formation containing oil shale which is suitable for in situ retorting can be hundreds of feet thick. Often there are strata of substantial thickness within such formation having significantly different kerogen contents than other strata in the same formation. Thus, for example, in one formation containing oil shale in Colorado that is a few hundred feet thick, the average kerogen content is in the order of about 17 gallons per ton. Within this formation there are strata 10 feet or so thick in which the kerogen content is in excess of 30 gallons per ton. In another portion of the same formation there is a stratum almost 30 feet thick having nearly zero kerogen content. Similar stratification of kerogen content occurs in many formations containing oil shale.

During the course of retorting an in situ oil shale retort, hot retorting gas flows downwardly through the fragmented mass of formation particles. The void fraction, which is the ratio of the volume of the voids or spaces between particles in the fragmented mass to the total volume of the fragmented permeable mass of particles in an in situ oil shale retort, influences the resistance of the fragmented mass to such gas flow. A fragmented mass with a high void fraction has low resistance to gas flow, while a fragmented mass with low void fraction has a high resistance to gas flow. Flow resistance of the fragmented mass is important inasmuch as retorting may be continued for an extensive period of time. For example, one experimental in situ retort about 80 feet high was retorted for over a period of 120 days. If there is a high resistance to gas flow, a relatively high pressure drop will occur along the length of the fragmented mass. As a result, the blowers or compressors used for inducing gas flow within the retort will operate at relatively high pressure (for example, 5 psig) which requires appreciably more energy for driving the compressor or blower than if the pressure drop is relatively low.

The total energy requirements can be relatively high because of the long time required for retorting. Higher pressure operation also can take a greater capital expenditure for blowers or compressors, and some gas leakage from the retort can occur, further reducing efficiency.

The pressure differential or pressure drop from the top to bottom for vertical movement of gas down through the fragmented mass in an in situ oil shale retort depends upon various parameters of the retort and retorting process such as lithostatic pressure, void fraction of the fragmented mass, particle size in the fragmented mass, the temperature pattern of the retorting and combustion zones, gas volumetric flow rates, grade of oil shale being retorted, rate of heating of the fragmented mass, gas composition, gas generation from mineral decomposition and the like.

It is also desirable in forming an in situ retort to keep the total void volume as low as possible because of the cost of mining to form a void into which formation containing oil shale is expanded. Further, when the void is formed in the retort site, removed formation either must be retorted by more cumbersome and polluting above ground techniques, or the shale oil is lost when the mined-out material is discarded. Thus, the operator of an in situ oil shale retort is faced with opposing economic considerations that must be balanced to optimize production and minimize costs. On one side is the cost and loss of total yield of the retort by mining out formation to create the same void volume for the fragmented mass and on the other side is the cost of energy and equipment for forcing the retorting gas through the fragmented mass.

SUMMARY OF THE INVENTION

A method for recovering liquid and gaseous products from an in situ oil shale retort in a subterranean formation is practiced on an in situ oil shale retort having a plurality of fragmented permeable masses of formation particles containing oil shale with an upper and at least one lower fragmented mass and with such fragmented masses separated by a zone of unfragmented formation. Such a zone of unfragmented formation between fragmented masses has a plurality of vertically extending holes therethrough for distributing fluid from the fragmented mass above to the fragmented mass below such zone of unfragmented formation. A processing gas is introduced into the upper fragmented mass and an off gas is withdrawn from such a lower fragmented mass for establishing a retorting zone in the upper fragmented mass and advancing the retorting zone downwardly through the upper fragmented mass, through such holes in the zone of unfragmented formation, and into and through such a lower fragmented mass. The oil shale within such fragmented masses is thereby retorted producing such liquid and gaseous products. The liquid products are recovered from the fragmented mass in which they are produced and the gaseous products are recovered in the off gas from such a lower fragmented mass.

Variations in the above-described method of recovering liquid and gaseous products can also be practiced. The processing gas for establishing and maintaining a retorting zone can be introduced into the upper fragmented mass or can be introduced into any lower fragmented mass through the provided holes in the zone of unfragmented formation lying over such lower fragmented mass. Additionally, the off gas can be withdrawn from any lower fragmented mass or such off gas can be withdrawn from the lower portion of the fragmented mass containing the retorting zone. By varying the location of introduction of the processing gas and the location of withdrawal of the off gas, a multiplicity of processing gas routes or pathways can be created within a retort containing a plurality of fragmented masses. For example, each fragmented mass can be retorted in sequence or the fragmented masses can be retorted sequentially except for selected fragmented masses which are omitted from the sequence. Certain fragmented masses can be selectively bypassed with the processing gas, if for some reason it is undesirable to retort such fragmented masses. Reasons for omitting or bypassing fragmented masses can include the presence of low void fractions, low kerogen content and/or aquifer zones.

A method is also provided for forming such an in situ oil shale retort useful in the practice of the method of this invention for the recovery of liquid and gaseous products from oil shale.

The method can include excavating a means for vertical gas flow adjacent the retort and separated from the fragmented masses by unfragmented formation. The means for vertical gas flow is excavated to provide for fluid communication between each fragmented mass and the vertical gas flow means. Appropriate valves are provided to permit or shut-off fluid communication between each fragmented mass and the vertical gas flow means. The vertical gas flow means also provides for both downflow of gas and upflow of gas for both introducing and recovering gas from each fragmented mass of the retort.

BRIEF DESCRIPTION OF THE DRAWINGS

These and other aspects of this invention will be more fully understood by reference to the following detailed description and the accompanying drawings in which.

DETAILED DESCRIPTION OF THE DRAWINGS

An in situ oil shale retort useful in the practice of the method of this invention comprises a plurality of fragmented permeable masses of formation particles containing oil shale, separated by a zone of unfragmented formation having a plurality of vertically extending holes therethrough for distributing fluid from the upper fragmented mass into such lower fragmented mass.

Figure 1:
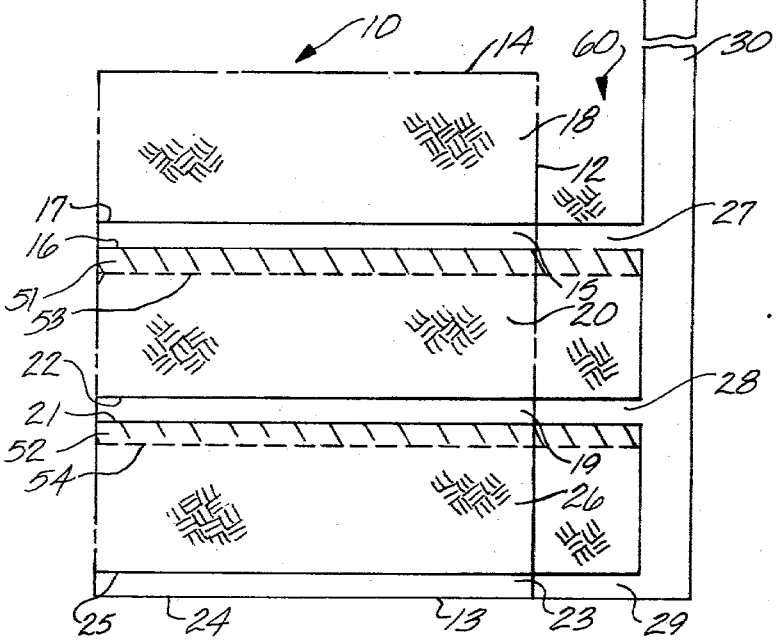
FIG. 1 is a schematic cross-sectional side view of an in situ oil shale retort at an intermediate stage of construction.
Figure 2:
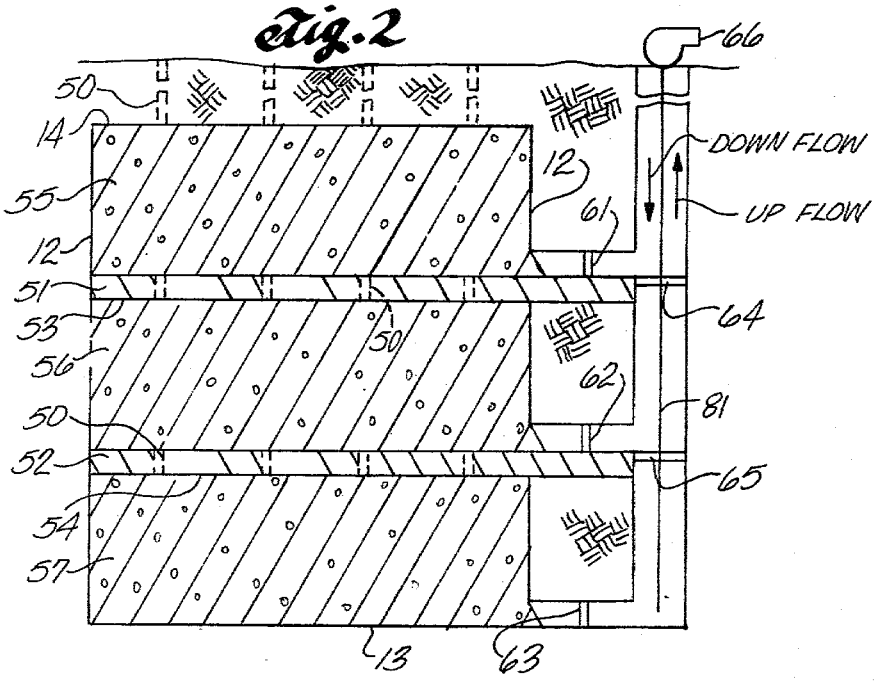
FIG. 2 is a schematic cross-sectional side view of an in situ oil shale retort of FIG. 1 at a later stage of formation.

With reference to FIGS. 1 and 2, an in situ oil shale retort is illustrated having side boundaries 12, a lower boundary 13 and a top boundary 14. Within these boundaries is a formation containing oil shale and having a plurality of strata of formation extending through the retort site defined by these boundaries. These various strata of formation contain varying concentrations of kerogen in the oil shale.

A portion of the formation is excavated from within the boundaries of the retort being formed to form an upper void 15. The upper void 15 has a floor 16 and a roof 17. Remaining unexcavated above upper void 15 is a first remaining portion of unfragmented formation 18 within the retort site. A second portion of the formation is excavated from within the boundaries of the retort being formed to form at least one lower void 19 substantially directly below the upper void 15. The lower void 19 can be excavated before, after or simultaneously with the excavation of the upper void 15. Remaining unexcavated above the lower void 19 is a second remaining portion of unfragmented formation 20 within the boundaries of the retort site and lying between the upper void 15 and the lower void 19.

As described above, at least one lower void is excavated directly below the upper void 15. By excavating at least one additional void within the boundaries of the retort being formed, a plurality of zones of unfragmented formation is left remaining within the boundaries of the retort site. For ease of description herein, the method will be described in terms of creating three such zones of unfragmented formations as illustrated in FIGS. 1 and 2. Therefore, an additional lower void 23 is excavated substantially directly below the upper void 15. The lower void 19 will hereinafter be referred to as intermediate void 19 having a floor 21 and a roof 22. The lowermost void 23, which will hereinafter be referred to as the lower void 23, has a floor 24 coinciding with lower boundary 13 and has a roof 25. Remaining unexcavated above the lower void 23 is a third remaining portion of unfragmented formation 26 within the boundaries of the retort site. As with intermediate void 19, the lower void 23 can be excavated before, during or after the excavation of any of the other voids.

The upper void 15, intermediate void 19 and lower void 23 can be excavated such as through access drifts 27, 28 and 29 respectively. As shown in the FIGS. 1, 2 and 4, a vertically extending passageway 30 is excavated along a side boundary 12 of the retort being formed, separated from the side boundary 12 by a gas barrier of unfragmented formation 60, and in communication with the retort site by the upper access drift 27, intermediate access drift 28 and lower access drift 29, all extending from the passageway 30 through the gas barrier 60 to the excavated voids and after explosive expansion, to the respective fragmented masses. The vertically extending passageway 30 and access drifts 27, 28, and 29 provide convenient means through which to remove debris from the excavations during the formation of the retort and to provide convenient access to locations above the fragmented masses and zones of unfragmented formation from which to conduct gas flow tests. Such a passageway 30 can be a vertically extending raise, shaft and the like.

The access drifts and the voids with which they communicate can be excavated such that the floors of the voids and access drifts slope downwardly from the retort site to the passageway 30. The floor 16 of the upper void 15, the floor 21 of the intermediate void 19 and the floor 24 of the lower void 23 can all be fitted with means for removing liquids formed during the retorting process from the fragmented masses into the access drifts and to the passageway 30. For example, such means for collecting the liquid can include sloping the floors to allow the liquid to flow from the fragmented masses into the access drifts and therefrom into passageway 30. The floors of the voids can also be troughed for collecting liquids and enhancing the flow of the liquids toward the access drifts. Further, the floors can be fitted with piping for collecting such liquid and for conveying such liquid toward the access drifts and passageway 30. Suitable means for collecting such liquid are disclosed in U.S. Pat. No. 4,007,963 which is incorporated herein by this reference. The zone of unfragmented formation between fragmented masses cannot capture all of the liquid products produced during retorting of the fragmented mass above such a zone of unfragmented formation because the zone of unfragmented formation contains holes 50 therethrough. Therefore, some of the liquid produced does flow into the fragmented mass below such a zone of unfragmented formation, however, by preparing means for capture and removal of such liquid much of the liquid formed in the fragmented mass above such a zone of unfragmented formation can be removed. Suitable sumps (not shown) can be created in the access drifts for collecting the liquid in each of the separate fragmented masses. From the sumps the liquid products can be transferred to and through passageway 30 for collection above ground.

The upper, intermediate and lower voids can be excavated having any desired configuration. In a preferred embodiment of this invention, each void is excavated such that the horizontal cross-sectional extent of the voids are substantially similar to the horizontal cross-sectional extent of the retort being formed. Pillars can be left within the voids for temporary support during the formation of the retort. Such pillars can be fragmented later when the fragmented masses are formed. The pillars are not shown in the drawings for simplicity. Further details of techniques for forming retorts using such horizontal void volumes are more fully described in U.S. Pat. Nos. 3,661,423; 4,043,597 and 4,043,598.

Figure 3:
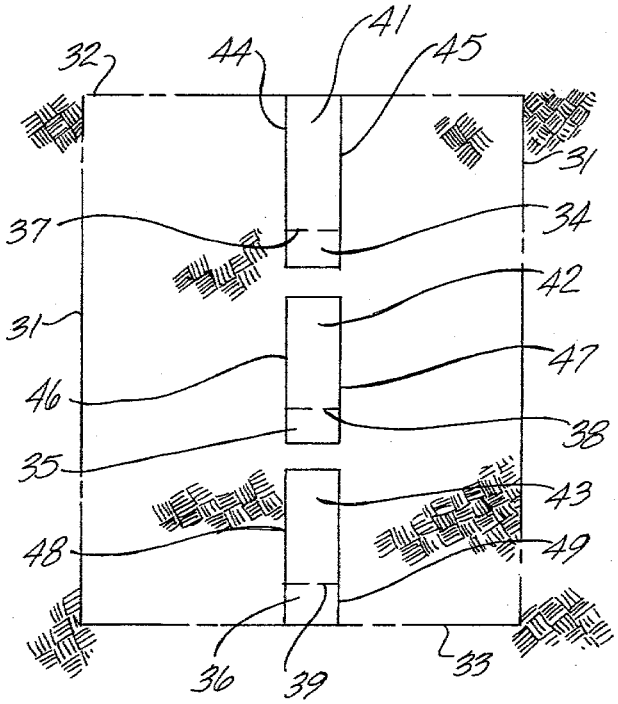
FIG. 3 is a schematic cross-sectional side view of another embodiment of an in situ oil shale retort at an intermediate stage of construction.

In another embodiment, the upper, intermediate and lower voids 15, 19 and 23 can be drifts extending from one side boundary to the opposite side boundary. Other forms of excavations such as rooms, a series of drifts, E-shaped drifts and the like can also be utilized for forming the upper, intermediate and lower voids. When the voids within the retort site are to be other than horizontal voids, the voids can include vertical voids excavated within the retort site as illustrated in FIG. 3. In FIG. 3 an in situ oil shale retort site is defined by side boundaries 31, top boundary 32 and lower boundary 33. An upper drift 34 is excavated extending between opposite sides 31 of the retort being formed. FIG. 3 is a schematic cross-sectional view of a retort site looking along the length of such an excavated upper drift 34. Similarly, an intermediate drift 35 and a lower drift 36 can be excavated, each extending between the sides of the retort site and positioned substantially directly below the upper drift 34. The unfragmented formation directly above the upper drift 34, the intermediate drift 35 and the lower drift 36 which is illustrated as being above dash lines 37, 38 and 39 respectively, is excavated forming vertically extending voids such as upper void 41, intermediate void 42 and lower void 43. The vertically extending voids form slots extending between the sides of the retort site. Each void is extended upward but is terminated prior to connecting with the drift lying above. Further details of techniques for forming retorts using such vertical void volumes are more fully described in U.S. Pat. Nos. 4,043,595 and 4,043,596.

Figure 4:
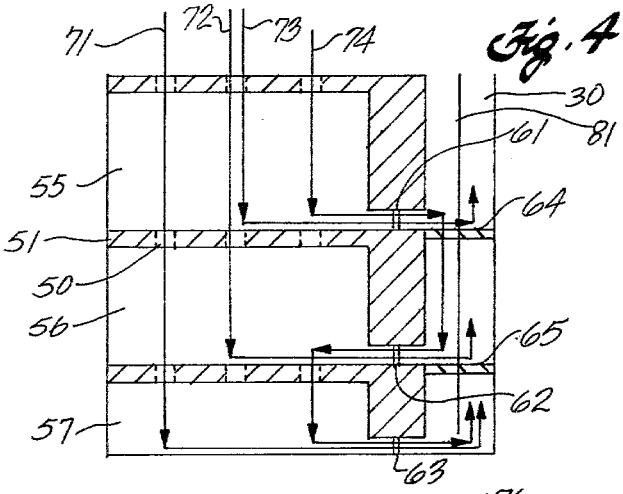
FIG. 4 is a schematic cross-sectional side view of an in situ oil shale retort illustrating the various pathways of gas flow in a retort of this invention.

In the embodiment shown in FIGS. 1 and 2, a separate retort level access drift extends into the retort site at the elevation of each horizontal void, and each of such access drifts can be centered in its respective horizontal void. Such drifts provide access for mining equipment used for excavating such voids. A variety of such access arrangements can be used. The surfaces of unfragmented formation 17, 22 and 25 (i.e. the roofs of the voids 15, 19 and 23) provide horizontal free faces toward which formation is explosively expanded for forming fragmented permeable masses of formation particles containing oil shale. When vertical voids are used for forming a plurality of fragmented masses as illustrated in FIG. 4, the surfaces of unfragmented formation 44, 45, 46, 47, 48 and 49 provide vertical free faces toward which formation is explosively expanded for forming such a plurality of fragmented permeable masses of formation particles containing oil shale.

A plurality of vertically extending holes 50 are drilled through the formation in the boundaries of the retort site. The holes 50 can be drilled at any convenient time during the formation process for the retort. The holes 50 can be drilled before, during or after the excavation of the upper, intermediate or lower voids. The holes 50 can be drilled from above the top boundary 14 such as in a drift or room positioned above the top boundary or from a location above the overburden above the retort site. Alternatively the holes can be drilled from the upper void 15, the intermediate void 19 or the lower void 23. The holes can have any convenient diameter and it is preferred the holes have a diameter of from about 6 inches to about 12 inches, and more preferably about 10 inches. The holes 50 can also function as blasting holes for use in the explosive expansion of the unfragmented formation within the retort site to form the fragmented permeable masses of formation particles. When such holes 50 are used to form the fragmented masses, they are loaded with explosive in such a manner that the segments of such a hole within a zone of formation to remain unfragmented contains no explosive. Thus, when the explosive is detonated, the segment of the hole with no explosive remains a zone of unfragmented formation. Such unfragmented formation is illustrated in FIG. 1 as a zone of unfragmented formation 51 and a zone of unfragmented formation 52 which are bounded by broken lines 53 and 54 respectively. The unfragmented formation zones 51 and 52 are also illustrated in FIGS. 2 and 4 which show such zones 51 and 52 lying between fragmented masses in the retort site.

The fragmented masses of the retort are formed by any convenient method such as described in the above mentioned patents. The zones of unfragmented formation such as upper unfragmented formation 18, intermediate unfragmented formation 20 and lower unfragmented formation 26 within the retort site are fragmented forming an upper fragmented mass 55, an intermediate fragmented mass 56 and lower fragmented mass 57 within the boundaries of the retort. The fragmenting process of the unfragmented formation is conducted in such a manner that the zones of unfragmented formation 53 and 54 remain substantially unfragmented and intact, thereby providing such zones of unfragmented formation remaining between fragmented masses.

The preferred method of forming the fragmented masses is by forming the lower fragmented mass 57 first and then forming the intermediate fragmented mass 56 and then the upper fragmented mass 55. The preference for forming the fragmented masses from the bottom of the retort upwards will be described in greater detail hereinafter, however, one reason for this route of formation is so that the void fraction in each fragmented mass can be measured and appropiate steps taken to correct any major deviation from an acceptable void fraction.

A preferred technique of forming the fragmented masses is by explosive expansion. The unfragmented formation 26 above the lower void 23 is explosively expanded toward a free face 25 provided by the lower void 23. Any pillars that had been left for support during the excavation of the lower void 23 are also explosively expanded to form the lower fragmented mass 57. The lower zone of unfragmented formation 26 is fragmented in such a manner forming the lower fragmented mass 57 leaving a zone of intervening unfragmented formation 52 above the lower fragmented mass 57. The construction of the in situ oil shale retort and the boundaries thereof are planned such that the zone of unfragmented formation 52 lies within a zone of relatively lower kerogen content oil shale than the average kerogen content of the oil shale formation within the retort site.

As hereinbefore mentioned, the voids can be formed at any convenient time during the formation of the in situ oil shale retort. However, since the voids provide the necessary free face toward which the unfragmented formation is explosively expanded, it is necessary that the voids be excavated prior to the explosive expansion of the formation immediately above the void. By conducting the formation of the retort by forming the fragmented masses from the bottom it is possible to test each fragmented mass formed and to correct deficiencies discovered in the fragmented masses. The excavated void immediately above the formed fragmented mass provides a working area from which to conduct tests on the newly formed fragmented mass. The zone of unfragmented formation lying between the void and fragmented mass also enables the testing of the fragmented mass. For example, following the formation of the lower fragmented mass the gas flow rate through the fragmented mass can be tested. This testing operation can be conducted from the intermediate void 19. The holes 50 can be drilled through the zone of unfragmented formation 52 between the intermediate void 19 and the lower fragmented mass 57. The holes 50 may have already been drilled through the entire height of the retort site such as from a workroom above the top of the retort site or from above the overburden of the retort site. Such holes 50 may have been drilled as blasting holes for explosively expanding the formation within the retort site to form the fragmented masses. The lower fragmented mass 57 is tested from the intermediate void 19 to determine the gas flow through the fragmented mass. If there is insufficient gas flow through the lower fragmented mass 57, the holes 50 can be sealed to prevent the flow of fluid therethrough and thereby prevent the retorting of the lower fragmented mass. If there is sufficient gas flow through the lower fragmented mass 20, the lower fragmented mass can be retorted.

The total cross-sectional area of the holes 50 in the zone of unfragmented formation 52 is preferred to be less than the total horizontal cross-sectional area of the void spaces in the fragmented mass 57 lying therebelow. It is preferred that the void fraction of each fragmented mass be greater than about 20 percent and the total horizontal cross-sectional area of the holes through the zone of unfragmented formation be less than about 20 percent of the horizontal cross-sectional area of the zone of unfragmented formation between the fragmented masses. When the total horizontal cross-sectional area of the holes through the zone of unfragmented formation is less than 20 percent, the zone of unfragmented formation acts like a tube sheet and tends to spread the gas flow uniformly thereby minimizing the effect of channeling of the gas flow through the fragmented mass therebelow. Such cross-sectional area of the holes 50 provides for even distribution of the fluid from above the zone of unfragmented formation 52 into the lower fragmented mass 57. The gas flow through the holes 50 can be tested and if an improper gas flow is found then the hole pattern can be changed to adjust the gas distribution to the zone of unfragmented formation. Additional holes can be drilled from the intermediate void 19 or some of such holes 50 can be plugged to insure proper gas flow and fluid distribution through the zone of unfragmented formation 52.

The zone of unfragmented formation 52 can lie within a stratum of formation such as an aquifer or an especially permeable stratum. If the zone of unfragmented formation does lie within such a strata it may be necessary to seal the zone of unfragmented formation from such aquifer or permeable stratum to prevent water from seeping into the underlying fragmented mass, to prevent the holes from plugging, to minimize gas leakage and/or to avoid possible loss of retorting products. The zone of unfragmented formation 52 can be sealed from such a stratum by forming a grout curtain along the boundary of the retort within the zone of unfragmented formation wherein the grout curtain acts as a barrier to prevent the passage of fluid therethrough. Such a grout curtain is formed by drilling into the unfragmented formation and pumping grout into the permeable formation at high pressure by techniques known in the mining art. Alternatively, the holes 50 can be cased or lined or coated with impervious material such as concrete grout to prevent fluid flow from or into such holes. By constructing the in situ oil shale retort forming the lower fragmented masses first, the void immediately above the zone of unfragmented formation above the formed fragmented mass provides a convenient access area in which to conduct the necessary work to create a grout curtain barrier or to case or line the holes 50.

Following the formation and testing of the lower fragmented mass 57 and the fluid distribution through the zone of unfragmented formation, the intermediate unfragmented formation 20 is fragmented to form the intermediate fragmented mass 56. As in the formation of the lower fragmented mass 57, the intermediate unfragmented formation 20 has a horizontal free face 22 toward which the unfragmented formation 20 can be explosively expanded. The unfragmented formation 20 is explosively expanded toward such a free face 22 leaving remaining a zone of unfragmented formation 51 between the newly formed fragmented mass 56 and the upper void 15. The intermediate fragmented mass 56 is then tested for the sufficiency of gas flow therethrough. Also, the gas distribution through the zone of unfragmented formation 51 is tested and the hole pattern changed if necessary. As with the zone of unfragmented formation 52, if the zone of unfragmented formation 51 is within a stratum of formation such as an aquifer or an especially permeable stratum, it too can be isolated from the in situ oil shale retort being formed by forming a grout curtain along the boundary of the retort or by lining the holes 50 through such a zone of unfragmented formation 51.

Following the testing of the intermediate fragmented mass 56, the upper fragmented formation 18 is explosively expanded towards a horizontal face 17 for forming the upper fragmented mass 55. The gas flow through the upper fragmented mass 55 is also tested.

An in situ oil shale retort is thereby created having a plurality of fragmented permeable masses of formation particles containing oil shale with the fragmented masses separated by zones of unfragmented formation having a plurality of vertically extending holes therethrough for distributing fluid from the fragmented mass above into the fragmented mass below such a zone of unfragmented formation. The zone can lie in a stratum of formation having low kerogen content and/or in strata containing an aquifer or other permeable stratum. Although described with reference to an in situ oil shale retort having three separated fragmented masses and two zones of unfragmented formation therebetween, an in situ oil shale retort can have two or more such fragmented masses separated by one or more such zones of unfragmented formation.

Each zone of unfragmented formation can lie within a stratum having a relatively lower kerogen content than the average kerogen content of the oil shale within the retort site. In this manner, an efficient retorting process is practiced wherein inefficient and uneconomical strata or zones of relatively low kerogen content oil shale is bypassed and not subjected to retorting. Such an in situ oil shale retort and method of recovery of liquid and gaseous products thereby saves time and energy as unnecessary strata within the formation are not fragmented and a retorting zone is not passed through a barren fragmented mass. Such an in situ oil shale retort and method of recovery also saves excavation costs for removing such barren or uneconomical strata. Costs and time are also saved in pumping since increased pressure is not required to advance the retorting zone through such a barren or relatively low kerogen content oil shale strata.

Prior to retorting the fragmented masses within the retort site, means 61, 62 and 63 for preventing or allowing the passage of gas are placed respectively in access drifts 27, 28 and 29. Such means 61, 62 and 63 can be any convenient means which can be regulated for permitting or not permitting the flow of gas, such as various valves.

A means 64 and 65 for permitting or not permitting the downflow of gas while simultaneously permitting or not permitting the upflow of gas are positioned within the vertically extending passageway 30 at about the elevation of the floor 16 of the upper fragmented mass and floor 21 of the intermediate fragmented mass. Such means can be valves or gas barriers containing pipe fittings or valves which will either allow or disallow the passage of gas. The vertically extending passageway 30 contains a vertical divider or brattice 81 which provides the capability of both downflow of a gas and an upflow of a gas in the passageway. The upflow of the gas and, in general, the flow of gas through an in situ oil shale retort, is provided by an exhaust means 66 such as a pump or fan. The exhaust means 66 connects to that section of the vertically extending passageway which provides for upflow of gases.

Following the completion of formation of the fragmented masses in such an in situ oil shale retort, a processing gas is introduced into the top portion of the upper fragmented mass 55 for establishing a retorting zone within the upper fragmented mass 55. An off gas is withdrawn from the lower portion of the lower fragmented mass 57 thereby advancing the retorting zone through the upper fragmented mass, through the holes 50 in the zone of unfragmented formation 51 and into and through the intermediate fragmented mass 56, through the holes 50 in the zone of unfragmented formation 52 and into and through the lower fragmented mass 57 for retorting oil shale and producing liquid and gaseous products.

Liquid produced from the retorting zone in the upper fragmented mass can be withdrawn from the floor 16 of the upper fragmented mass 55 and into upper access drift 27. Some liquid products can, however, flow through such holes 50 in the zone of unfragmented formation 51 and flow through the intermediate fragmented mass for collection at floor 21, or such liquid products can flow through such holes 50 in the lower zone of unfragmented formation 52 and through the lower fragmented mass 57 for collection at the bottom boundary 13 of the lower fragmented mass 57. If desired, all of the liquid products can be channeled through such holes 50 through the zones of unfragmented formation for collection at the bottom boundary 13 of the lower fragmented mass 57.

The off gas being withdrawn from the retorting zone in the upper fragmented mass 55 is drawn through the holes 50 and into the intermediate fragmented mass 56 for advancing the retorting zone through the intermediate fragmented mass. The retorting zone passes through the holes 50 through a zone of unfragmented formation 51 and heats only a limited volume of the unfragmented formation within that zone. The holes 50 through the zone of unfragmented formation provide efficient means for passing the retorting zone through a zone of barren oil shale or through a strata within the formation such as an aquifer or a permeable layer which generally hinders the progress and advancement of the retorting zone. By bypassing such a zone, there is less requirement to increase the pressure advancing the retorting zone through such a barren or deleterious strata of formation.

When processing gas introduced for establishing and advancing the retorting zone is an oxygen containing gas, a combustion zone is established within the upper portion of the upper fragmented mass. An oxygen supplying gas is then introduced to sustain the combustion zone and to advance the combustion zone downwardly through the upper fragmented mass. Hot gas from the combustion zone establishes a retorting zone on the advancing side of the combustion zone. Withdrawing an off gas from the lower portion of the fragmented mass advances the retorting zone and the combustion zone downwardly through the upper fragmented mass. When the off gas is withdrawn from the lower fragmented mass, the combustion zone and retorting zone advance downwardly through the upper fragmented mass, through the holes in the upper zone of unfragmented formation, through the intermediate fragmented mass, through the holes in the lower zone of unfragmented formation and through the lower fragmented mass. This process can be continued through a plurality of such fragmented masses, each separated from the one below by a zone of unfragmented formation having a plurality of holes therein for distributing fluid from the fragmented mass lying above to the fragmented mass lying below the zone of unfragmented formation.

In operation, an in situ oil shale retort as herein described, can be retorted in a variety of different gas flow pathways depending upon the number of fragmented masses within the retort and whether the fragmented masses are to be retorted or bypassed. It can be desirable, for example, to bypass a fragmented mass when the resistance to gas flow is inordinately high and makes retorting uneconomical. Adjacent masses can still be retorted for maximizing yield.

Figure 5:
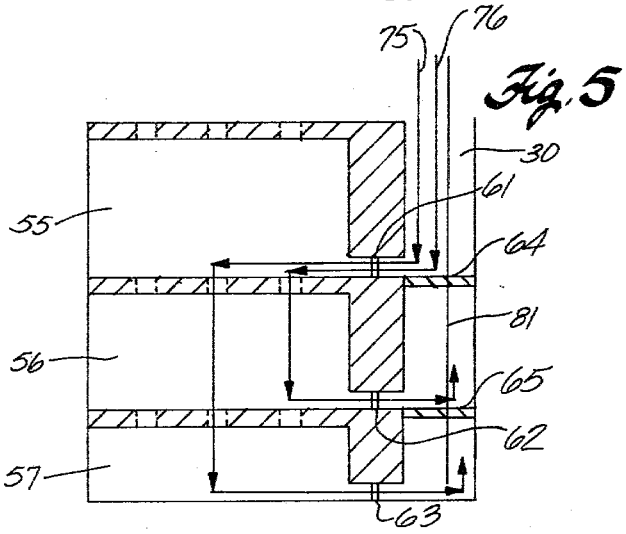
FIG. 5 is a schematic cross-sectional side view of an in situ oil shale retort illustrating various pathways of gas flow in a retort of this invention.
Figure 6:
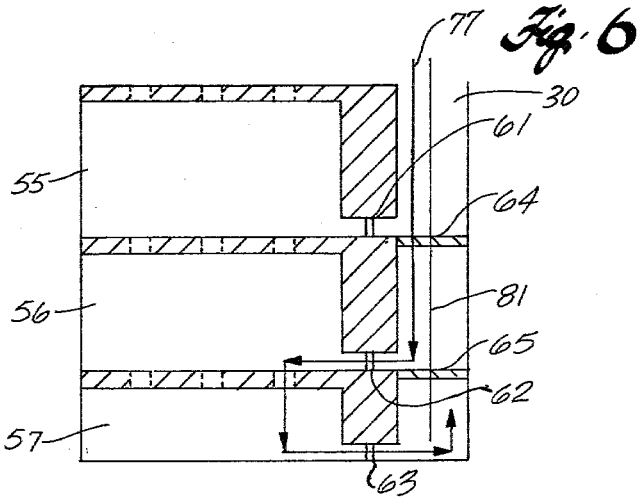
FIG. 6 is a schematic cross-sectional side view of an in situ oil shale retort illustrating a pathway of gas flow in a retort of this invention.

With reference to FIGS. 4, 5 and 6 the gas flow pathways are schematically illustrated for an in situ oil shale retort having three separated fragmented masses. In such an in situ oil shale retort there are seven possible gas flow pathways as illustrated by gas flow pathways 71 through 77 in the figures.

For pathway 71 the valve 63 within the lower access drift is opened to allow the flow of gas and the valves 61 and 62 within the upper and intermediate access drifts are closed to prevent the flow of gas. As above described, processing gas is introduced at the top of the upper fragmented mass and off gas is withdrawn from the bottom of the lower fragmented mass.

For pathway 72 a processing gas is introduced at the top of the upper fragmented mass. The valves 61 and 63 within the upper and lower access drifts are closed to prevent the flow of gas while the valve 62 within the intermediate access drift is opened to allow the flow of gas. The valve 64 within the passageway 30 is also closed to prevent the downflow of gas but is open to allow the upflow of gas. Valve 65 is closed to prevent the downflow of gas therethrough.

For pathway 73 a processing gas is introduced at the top of the upper fragmented mass and the valve 63 and 62 within the lower and intermediate access drifts are closed to prevent the flow of gas. Valve 61 within the upper access drift is open to allow the flow of gas. The valve 64 is positioned to prevent the flow of gas. The gas withdrawn from the retorting process is withdrawn through the upper access drift and through passageway 30.

For pathway 74 a processing gas is introduced at the top of the upper fragmented mass. The valves 61, 62 and 63 are open to allow the flow of gas. The valve 65 is closed to prevent the downflow of gas but opened to allow the upflow of gas. The valve 64 is opened to allow the downflow and upflow of gas. The holes 50 within the upper zone of unfragmented formation 51 are sealed to prevent the passage of gas therethrough.

With reference now to FIGS. 5 and 6, pathways 75–77 are described. In these pathways the holes 50 extending through the overburden mass are sealed to prevent the flow of gas therethrough. For pathway 75, 76, and 77 the processing gas is introduced into the retort site through the passageway 30. For pathway 75 the valve 62 within the intermediate access drift is closed to prevent the flow of gas and the valves 61 and 63 within the upper and the lower access drifts are opened to allow the flow of gas. The valve 65 is closed to prevent the downflow of gas but open to allow the upflow of gas. For pathway 76 the valves 61 and 62, within the upper and intermediate access drifts, are opened to permit the flow of gas while the valve 63 within the lower access drift is closed to prevent the flow of gas. The valve 64 is closed to prevent the downflow of gas but open to allow the upflow of gas. For pathway 77 the valve 61 in the upper access drift is closed to prevent the flow of gas. The valves 63 and 62 within the lower and the intermediate access drifts are opened to allow the flow of gas. The valve 65 is closed to prevent the downflow of gas but opened to allow the upflow of gas. The valve 64 is open to allow both downflow and upflow of gas.

If there is good gas flow through the entire retort, the gas flow can be adjusted to follow pathway 71. However, if there is inadequate gas flow through any one or more of the fragmented masses, then one of the other gas flow pathways can be utilized. For example, if gas flow in the lower fragmented mass is undesirable, the lower fragmented mass can be bypassed using pathways 72 or 73. Pathway 73 can also be used if only the upper fragmented mass is to be retorted.

Rather than using any one of the possible gas flow pathways, a combination of the various pathways can be used during the retorting process for the retort. By opening and closing the various valves, the most efficient gas flow pathway can be utilized at various times during the retorting process. For example, if all three fragmented masses are to be retorted the initial gas flow pathway can be either gas flow pathway 71 or 72. As the retorting zone reaches the upper zone of unfragmented formation 51 lying between the upper and intermediate fragmented masses, the retorting zone passes through such zone through the holes 50 in such zone. After the retorting zone has essentially passed through the upper zone of unfragmented formation into the intermediate fragmented mass, the upper fragmented mass can be bypassed such as by pathway 75. The retorting zone then advances downwardly through the intermediate fragmented mass producing liquid and gaseous products. Total pressure differential through the retort can thereby be minimized.

Many combinations of the available pathways are possible. However, it is advantageous when the retorting zone is within one fragmented mass to withdraw the off gas from such a retorting zone into and through the lower fragmented mass. By withdrawing the off gas through such a fragmented mass below the fragmented mass with the retorting zone, the second fragmented mass is preheated by the high temperature off gas to prepare such fragmented mass for the retorting zone.

Possible combinations of gas flow pathways are 72 and 71; 72 and 75; 73, 72 and 71; and 71 and 75.

Although previously discussed herein with regard to one processing gas being introduced to the fragmented masses of the retort, the method herein can also comprise the retorting of the fragmented masses for recovering liquid and gaseous products by using a combination of processing gas flow paths. Using a combination of processing gas flow paths can produce a lower pressure differential across a fragmented mass as the total mass of the processing gas has been split into more than one feed stream.

It is at times preferred to split the processing gas stream to a fragmented mass into more than one stream with each stream comprising different components of the processing gas. Preferably, the processing gas can be introduced to a fragmented mass in two separate streams, one stream comprising an oxygen-supplying gas and the second stream comprising steam. Dividing the processing gas into two such streams and introducing both streams at different locations within the retort provides two benefits over using a single feed stream. A first benefit realized is that of reducing the pressure differential across a fragmented mass. The second benefit is less dilution of the oxygen-supplying gas when the streams are divided. Less dilution of the oxygen-supplying gas provides better combustion of the materials in the combustion zone. That is, with a higher available oxygen concentration there is more burning of the carbon-containing material in the combustion zone in the fragmented mass.

With reference to FIGS. 4 and 5, a method for recovering liquid and gaseous products using divided processing gas flow during at least a portion of the retorting process on an in situ oil shale retort containing a plurality of fragmented masses separated by zones of unfragmented formation having holes extending therethrough is described. For example, in an in situ oil shale retort comprising three fragmented masses, as illustrated in FIGS. 4 and 5, a processing gas comprising at least an oxygen-supplying gas and steam is introduced to the retort by a pathway selected from 71, 72, 73 and 74. The processing gas establishes a combustion zone within the upper fragmented mass. Withdrawing the off gas from the upper fragmented mass in any of the illustrated pathways advances the combustion zone downwardly through the upper fragmented mass and establishes a retorting zone on the advancing side of the combustion zone. If the intermediate fragmented mass is to be retorted, then the off gas is withdrawn through the intermediate fragmented mass by pathways 71 or 72. As the off gas is withdrawn from the combustion zone in the upper fragmented mass, the hot off gas preheats the intermediate fragmented mass in preparation for establishing the retorting zone and combustion zone in the intermediate fragmented mass. As the combustion zone advances downwardly, the retorting zone passes through the holes 50 in the zone of unfragmented formation 51 and is established within the intermediate fragmented mass. After the retorting zone has been established in the intermediate fragmented mass, the processing gas can be split into two streams comprising essentially an oxygen-supplying gas stream and a steam stream. The oxygen-supplying gas stream continues to be introduced through the upper fragmented mass by pathway 71 or 72. The steam gas stream is introduced by pathway 75 or 76 through the upper access drift 27. As less mass of processing gas is being passed through the upper fragmented mass, the pressure drop across the upper fragmented mass is lowered. The oxygen-supplying gas is less diluted and therefore provides better combustion of the combustible materials in the upper fragmented mass. As the efficiency of the combustion zone is increased, the available heat therefrom is also efficiently utilized. The available heat from the combustion, downstream of the combustion because of the gas flow, is carried by the steam gas stream into the intermediate fragmented mass and the retorting zone therein. The more efficient combustion of the combustible materials provided by the more concentrated oxygen-supplying gas can slow the advancement of the combustion zone and, therefore, the retorting zone through the fragmented masses. As the advancement of the combustion zone slows and more efficiently combusts, it provides a high quantity of heat to a correspondingly slow moving retorting zone for efficiently producing liquid and gaseous products.

The method herein provides for retorting of oil shale within a formation with selective retorting of oil shale within the formation. The method provides for selectively bypassing zones of formation for which it is undesirable to retort. The shorter fragmented masses created by the method herein provide shorter retorting paths through which a retorting zone has to pass. Such shorter retorting paths means the fragmented masses in the retort site can have lower void volumes than one continuous fragmented mass in a retort site of the approximate same height and still have the same pressure drop. The availability of a lower void volume means that less mining and excavating of a void is required and more oil shale formation of desired kerogen content within the fragmented mass area to be formed are available for retorting. That is, with a lower void volume there is more available shale oil to be recovered in any given fragmented mass. Additionally, the method of providing such a plurality of fragmented masses within a retort site makes it possible to adjust the void volume within each fragmented mass to suit the conditions of the oil shale formation within the particular zone of formation forming each fragmented mass. The method herein, therefore, allows for the balancing of economic considerations in operating an in situ oil shale retort. The cost and loss of total yield of shale oil from a retort by mining out formation to create the void volume for the fragmented mass can be balanced against the cost of energy and equipment for forcing a processing gas through the fragmented masses within the retort site. The method allows for minimizing these costs and maintain or optimize liquid and gaseous product recovery.

For ease of discussion and illustration, the gas flow during the retorting process was described in relation to a retort comprising three unfragmented masses. Such a retort was chosen for convenience of explanation of the possible gas flow pathways. However, an in situ retort, as herein described, can comprise a plurality of fragmented masses and can be retorted in any manner utilizing such gas flow pathways as herein described and illustrated.

What is claimed is:

1. A method for recovering liquid and gaseous products from an in situ oil shale retort in a subterranean formation containing oil shale, the method comprising the steps of:

forming a plurality of vertically extending holes through at least a portion of the subterranean formation within an in situ oil shale retort site;

forming at least an upper and a lower fragmented permeable mass of formation particles containing oil shale in the retort site, leaving between such fragmented masses an intervening zone of unfragmented formation having a plurality of such vertically extending holes through the zone of unfragmented formation for distributing fluid from the upper fragmented mass into the lower fragmented mass;

introducing a processing gas to the upper fragmented mass and withdrawing an off gas from the lower fragmented mass for establishing a retorting zone in the upper fragmented mass and advancing the retorting zone downwardly through the upper fragmented mass, through such holes in the zone of unfragmented formation, and into and through the lower fragmented mass, for retorting oil shale in such fragmented masses and producing liquid and gaseous products; and withdrawing such liquid products from the fragmented mass from which they are produced, such gaseous products being withdrawn in such off gas from the lower fragmented mass.

2. A method as recited in claim 1 wherein at least a portion of the liquid products produced in the upper fragmented mass is withdrawn from the upper fragmented mass into such lower fragmented mass through such a vertically extending hole through the zone of unfragmented formation.

3. A method as recited in claim 1 wherein the zone of unfragmented formation has an average kerogen content relatively lower than the average kerogen content of formation containing oil shale in the retort site.

4. A method as recited in claim 1 wherein the zone of unfragmented formation lies within an aquifer zone, and the method comprises sealing the holes extending through the zone of unfragmented formation from the aquifer zone for inhibiting flow of water from the aquifer zone into the holes.

5. A method as recited in claim 1 wherein the void fraction of each fragmented mass is greater than about 20 percent and the total horizontal cross-sectional area of the holes through the zone of unfragmented formation is less than about 20 percent of the horizontal cross-sectional area of the zone of unfragmented formation between such fragmented masses.

6. A method as recited in claim 1 including establishing a combustion zone in an upper portion of the upper fragmented mass and wherein said processing gas advances the combustion zone through said upper fragmented mass, through such holes in the zone of unfragmented formation, and into and through the lower fragmented mass, the retorting zone being established and advanced on the advancing side of the combustion zone by heat of combustion from the combustion zone, the processing gas for sustaining and advancing the combustion zone being supplied through such holes in the zone of unfragmented formation after the combustion zone enters the lower fragmented mass.

7. A method as recited in claim 1 further comprising forming at least one means for vertical gas flow separated from the retort by a gas barrier and in communication with the upper fragmented mass in said retort by an access drift between the means for gas flow and the side boundary of the upper fragmented mass and in communication with the lower fragmented mass in said retort by an access drift between the means for gas flow and the side boundary of the lower fragmented mass.

8. A method as recited in claim 7 wherein such an access drift is excavated with the floor of the access drift at about the same elevation as the top of the zone of unfragmented formation between voids.

9. A method for recovering liquid and gaseous products from an in situ oil shale retort in a subterranean formation containing oil shale, the method comprising the steps of:

excavating an upper void within the retort site leaving a first remaining portion of unfragmented formation within the retort site above the upper void;

excavating at least one lower void within the retort site substantially directly below the upper void, leaving a second remaining portion of unfragmented formation within the retort site between said voids;

forming a plurality of vertically extending holes in at least the second remaining portion of the subterranean formation;

explosively expanding a part of the second remaining portion of unfragmented formation within the retort site between such voids toward the lower void and at least a part of the first remaining portion of unfragmented formation within the retort site above said upper void toward the upper void for forming at least an upper and a lower fragmented permeable mass of formation particles containing oil shale, leaving between such fragmented masses an intervening zone of unfragmented formation having a plurality of vertically extending holes through the unfragmented formation for distributing fluid from the upper fragmented mass into the lower fragmented mass;

introducing a processing gas to the upper fragmented mass and withdrawing an off gas from the lower fragmented mass for establishing a retorting zone in the upper fragmented mass and advancing the retorting zone through the upper fragmented mass, through such holes in the zone of unfragmented formation, and into and through the lower fragmented mass, for retorting oil shale in such fragmented masses and producing liquid and gaseous products; and withdrawing such liquid and gaseous products.

10. A method as recited in claim 9 wherein the excavated upper and lower voids each have a horizontal cross-sectional extent substantially similar to the horizontal cross-sectional extent of the retort being formed.

11. A method as recited in claim 9 wherein the first remaining portion of formation above the upper void has a horizontally extending free face adjacent the upper void towards which the first remaining portion of formation above the upper void is explosively expanded and wherein the second remaining portion of formation above the lower void has a horizontally extending free face adjacent the lower void toward which a portion of the second remaining portion of formation above the lower void is explosively expanded.

12. A method as recited in claim 9 wherein the upper void comprises a vertically extending void and the first remaining portion of formation above has at least one vertically extending free face toward which the first remaining portion of formation is explosively expanded, and wherein the lower void comprises a vertically extending void and the second remaining portion of formation has at least one vertically extending free face toward which a part of the second remaining portion of formation is explosively expanded.

13. A method as recited in claim 9 wherein the lower fragmented mass is formed by explosie expansion before the upper fragmented mass is formed by explosive expansion.

14. A method as recited in claim 9 wherein the zone of unfragmented formation has an average kerogen content relatively lower than the average kerogen content of formation containing oil shale in the retort site.

15. A method as recited in claim 9 wherein the zone of unfragmented formation lies within a permeable strata and the method comprises sealing the holes extending through the zone of unfragmented formation for inhibiting the flow of fluid into such permeable strata.

16. A method as recited in claim 9 wherein the void fraction of each fragmented mass is greater than about 20 percent and the total horizontal cross-sectional area of the holes through the zone of unfragmented formation is less than about 20 percent of the horizontal cross-sectional area of the zone of unfragmented formation between such fragmented masses.

17. A method as recited in claim 9 further comprising forming at least one means for vertical gas flow separated from the retort by a gas barrier and in communication with the upper fragmented mass in said retort by an access drift between the means for vertical gas flow and the side boundary of the upper fragmented mass and in communication with the lower fragmented mass in said retort by an access drift between the means for vertical gas flow and the side boundary of the lower fragmented mass.

18. A method as recited in claim 17 wherein such an access drift is excavated with the floor of the access drift at about the same elevation as the top of the zone of unfragmented formation between voids.

19. A method as recited in claim 1 or 9 wherein the processing gas comprises at least an oxygen-supplying gas and steam and wherein after the retorting zone has advanced through the holes in the unfragmented formation into the fragmented mass therebelow, the processing gas is divided into two separate streams, a first stream comprising at least such oxygen-supplying gas and a second stream comprising steam, the first stream is introduced into an upper portion of the upper fragmented mass and the second stream is introduced into a lower portion of the upper fragmented mass.

20. A method for forming an in situ oil shale retort in a subterranean formation containing oil shale and having a plurality of strata of formation extending through a retort site, at least one stratum of formation having a relatively lower kerogen content than the average kerogen content of formation within the retort site, the method comprising the steps of:

forming a plurality of vertically extending holes through a portion of the subterranean formation within the retort site; and forming at least an upper and a lower fragmented permeable mass of formation particles containing oil shale within the retort site, leaving between the upper and lower fragmented masses an intervening zone of unfragmented formation containing at least one stratum of formation having a relatively lower kerogen content than the average kerogen content of formation within the retort site, said zone of unfragmented formation having a plurality of such vertically extending holes for distributing fluid from the upper fragmented mass directly into the lower fragmented mass.

21. A method as recited in claim 20 wherein the lower fragmented mass is formed before the upper fragmented mass is formed.

22. A method as recited in claim 20 wherein the total horizontal cross-sectional area of the holes in such a zone of unfragmented formation between adjacent fragmented masses is less than the void fraction in the fragmented mass below the zone of unfragmented formation.

23. A method as recited in claim 20 wherein the void fraction of each fragmented mass is greater than about 20 percent and the total horizontal cross-sectional area of the holes through the zone of unfragmented formation is less than about 20 percent of the horizontal cross-sectional area of the zone of unfragmented formation between such fragmented masses.

24. A method as recited in claim 20 wherein the zone of unfragmented formation lies within an aquifer zone, the method comprising sealing the holes extending through the zone of unfragmented formation from the aquifer zone for inhibiting flow of water from the aquifer zone into the holes.

25. A method as recited in claim 20 further comprising forming at least one means for vertical gas flow separated from the retort by a gas barrier and in communication with the upper fragmented mass in said retort by an access drift between the means for gas flow and the side boundary of the upper fragmented mass and in communication with the lower fragmented mass in said retort by an access drift between the means for gas flow and the side boundary of the lower fragmented mass.

26. A method as recited in claim 25 wherein such an access drift is excavated with the floor of the access drift at about the same elevation as the top of the zone of unfragmented formation between voids.

27. A method for forming an in situ oil shale retort in a subterranean formation containing oil shale and having a plurality of strata of formation extending through a retort site, at least one stratum of formation having a relatively lower kerogen content than the average kerogen content of formation within the retort site, the method comprising the steps of:

excavating an upper void within the retort site leaving a first remaining portion of unfragmented formation within the retort site above the upper void;

excavating at least one lower void within the retort site substantially directly below the upper void leaving a second remaining portion of unfragmented formation within the retort site between such voids, the second remaining portion of formation containing at least one stratum of formation having a relatively lower kerogen content than the average kerogen content of formation within the retort site;

forming a plurality of vertically extending holes through at least a part of the second remaining portion of formation; and explosively expanding the first remaining portion of formation within the retort site toward the upper void for forming an upper fragmented permeable mass of formation particles containing oil shale, explosively expanding a part of the second remaining portion of formation within the retort site toward the lower void for forming a lower fragmented permeable mass of formation particles containing oil shale, leaving between the upper and lower fragmented masses an intervening zone of unfragmented formation containing at least one stratum of formation having a relatively lower kerogen content than the average kerogen content of formation within the retort site, said zone of unfragmented formation having a plurality of such vertically extending holes for distributing fluid from the upper fragmented mass directly into the lower fragmented mass.

28. A method as recited in claim 27 wherein the lower fragmented mass is formed before the upper fragmented mass is formed.

29. A method as recited in claim 27 wherein the total horizontal cross-sectional area of the holes in such a zone of unfragmented formation between adjacent fragmented masses is less than the void fraction in the fragmented mass below the zone of unfragmented formation.

30. A method as recited in claim 27 wherein the void fraction of each fragmented mass is greater than about 20 percent and the total horizontal cross-sectional area of the holes through the zone of unfragmented formation is less than about 20 percent of the horizontal cross-sectional area of the zone of unfragmented formation between such fragmented masses.

31. A method as recited in claim 27 wherein the zone of unfragmented formation lies within an aquifer zone and the method comprises sealing the holes extending through the zone of unfragmented formation from the aquifer zone for inhibiting flow of water from the aquifer zone into the holes.

32. A method as recited in claim 27 further comprising forming at least one means for vertical gas flow along the retort separated from the retort by a gas barrier and in communication with the upper fragmented mass in said retort by an access drift between the means for gas vertical flow and the side boundary of the upper fragmented mass and in communication with the lower fragmented mass in said retort by an access drift between the means for gas vertical flow and the side boundary of the lower fragmented mass.

33. A method as recited in claim 32 wherein such an access drift is excavated with the floor of the access drift at about the same elevation as the top of the zone of unfragmented formation between voids.

34. A method as recited in claim 27 wherein the excavated upper and lower voids each have a horizontal cross-sectional extent substantially similar to the horizontal cross-sectional extent of the retort being formed.

35. A method as recited in claim 27 further comprising loading explosive in at least a portion of such holes and detonating such explosive for explosively expanding the first remaining portion of formation and said part of the second remaining portion of formation within the retort site.

36. A method for recovering liquid and gaseous products from an in situ oil shale retort in a subterranean formation containing oil shale, the method comprising:

forming a plurality of vertically extending holes through a portion of the subterranean formation within a retort site;

forming an upper fragmented permeable mass, an intermediate fragmented permeable mass and a lower fragmented permeable mass of formation particles containing oil shale, leaving a first intervening zone of unfragmented formation between the upper and intermediate fragmented masses and leaving a second intervening zone of unfragmented formation between the intermediate and lower fragmented masses, each zone of unfragmented formation having a plurality of vertically extending holes for distributing fluid from the fragmented mass above to the fragmented mass below the zone of unfragmented formation;

forming a vertically extending passageway separated from the fragmented masses by a gas barrier of unfragmented formation;

excavating a first access drift between the vertically extending passageway and a side boundary of the upper fragmented mass, the floor of the first access drift being at about the same elevation as the top of the first zone of unfragmented formation;

excavating a second access drift between the vertically extending passageway and a side boundary of the intermediate fragmented mass, the floor of the second access drift being about the same elevation as the top of the second zone of unfragmented formation;

excavating a third access drift between the vertically extending passageway and a side boundary of the lower fragmented mass, the floor of the third access drift being at about the same elevation as the floor of the lower fragmented mass;

sealing the first and third access drifts for preventing the flow of gas therethrough;

introducing a processing gas into the upper portion of the upper fragmented mass and withdrawing an off gas from the second access drift for establishing a retorting zone in the upper fragmented mass and advancing the retorting zone through the upper fragmented mass, through such holes in the first zone of unfragmented formation, and into the intermediate fragmented mass for retorting oil shale and producing liquid and gaseous products;

thereafter sealing the second access drift to prevent the flow of gas therethrough, opening the third access drift, and withdrawing the off gas from the third access drift;

opening the first access drift and introducing processing gas through the first access drift, through the holes in the first zone of unfragmented formation and into the intermediate fragmented mass after the retorting zone has entered the intermediate fragmented mass, for advancing the retorting zone through the intermediate fragmented mass, through such holes in the second zone of unfragmented formation, and into the lower fragmented mass for retorting oil shale and producing liquid and gaseous products;

sealing the first access drift to prevent the flow of gas therethrough, opening the second access drift and introducing processing gas through the second access drift after the retorting zone has entered the lower fragmented mass, for advancing the retorting zone through the lower fragmented mass for retorting oil shale and producing liquid and gaseous products; and withdrawing such liquid and gaseous products.

37. A method as recited in claim 36 wherein such liquid products are substantially withdrawn from the fragmented mass in which they are formed and such gaseous products are withdrawn in the off gas.

38. A method as recited in claim 36 wherein the processing gas comprises at least an oxygen-supplying gas and steam and wherein after the retorting zone has advanced through the holes in a zone of unfragmented formation from a fragmented mass above such a zone of unfragmented formation into the fragmented mass below such unfragmented zone, the processing gas is divided into two separate streams, a first stream comprising at least an oxygen-supplying gas and a second stream comprising steam, the first stream is introduced into an upper portion of the fragmented mass above such zone of unfragmented formation and the second stream is introduced into a lower portion of the fragmented mass above such zone of unfragmented formation.

39. A method as recited in claim 38 wherein the second stream is introduced into a fragmented mass through the access drift extending between the vertically extending passageway and fragmented mass.

40. An in situ oil shale retort in a subterranean formation containing oil shale comprising:

a plurality of vertically spaced apart fragmented permeable masses of formation particles containing oil shale including an upper fragmented mass and at least one lower fragmented mass substantially directly below said upper fragmented mass and separated from said upper fragmented mass by a zone of unfragmented formation containing a plurality of vertically extending holes therethrough for distributing fluid from the upper fragmented mass directly into the lower fragmented mass.

41. An in situ oil shale retort as recited in claim 40 wherein the zone of unfragmented formation has an average kerogen content relatively lower than the average kerogen content of formation containing oil shale in the retort site.

42. An in situ oil shale retort as recited in claim 40 wherein the total horizontal cross-sectional area of the holes in such a zone of unfragmented formation between adjacent fragmented masses is less than the void fraction in the fragmented mass below the zone of unfragmented formation.

43. An in situ oil shale retort as recited in claim 40 wherein the void fraction of each fragmented mass is greater than about 20 percent and the total horizontal cross-sectional area of the holes through the zone of unfragmented formation is less than about 20 percent of the horizontal cross-sectional area of the zone of unfragmented formation between such fragmented masses.

44. An in situ oil shale retort as recited in claim 40 wherein the zone of unfragmented formation lies within an aquifer zone, the holes extending through the zone of unfragmented formation being sealed from the aquifer zone for inhibiting flow of water from the aquifer zone into the holes.

* * * * *

UNITED STATES PATENT AND TRADEMARK OFFICE

CERTIFICATE OF CORRECTION

PATENT NO. : 4,239,283

DATED : December 16, 1980

INVENTOR(S) : Richard D. Ridley

It is certified that error appears in the above-identified patent and that said Letters Patent are hereby corrected as shown below:

Column 10, line 2, change "fragmented" to -- unfragmented --.
Column 15, line 23, change "maintain" to -- maintaining --.
Column 15, line 23, change "optimize" to -- optimizing --.
Column 17, line 43, change "explosie" to -- explosive --.

Signed and Sealed this

*Twenty-third* Day of *February 1982*

[SEAL]

*Attest:*

GERALD J. MOSSINGHOFF

*Attesting Officer*

*Commissioner of Patents and Trademarks*